US006866365B1

(12) United States Patent
Neese et al.

(10) Patent No.: US 6,866,365 B1
(45) Date of Patent: Mar. 15, 2005

(54) BI-DIRECTIONAL COLOR PRINTER AND METHOD OF PRINTING

(75) Inventors: David A. Neese, Escondido, CA (US); Peter J. Fellingham, San Diego, CA (US); Timothy T. Grady, San Diego, CA (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/816,250

(22) Filed: Apr. 1, 2004

(51) Int. Cl.[7] ..... B41J 2/21
(52) U.S. Cl. ..... 347/43
(58) Field of Search ..... 347/43, 42, 9, 347/15, 19, 14, 12, 40

(56) References Cited

U.S. PATENT DOCUMENTS

| | | | | |
|---|---|---|---|---|
| 4,746,935 | A | 5/1988 | Allen | |
| 4,952,942 | A | 8/1990 | Kanome et al. | |
| 4,967,203 | A | 10/1990 | Doan et al. | |
| 5,075,689 | A | 12/1991 | Hoisington et al. | |
| 5,376,958 | A | 12/1994 | Richtsmeier et al. | |
| 5,416,612 | A | 5/1995 | Ingraham et al. | |
| 5,992,962 | A | 11/1999 | Yen et al. | |
| 6,033,055 | A | 3/2000 | Nagoshi et al. | |
| 6,067,405 | A | 5/2000 | Serra | |
| 6,106,102 | A | 8/2000 | Richtsmeier et al. | |
| 6,142,605 | A | 11/2000 | Serra et al. | |
| 6,244,688 | B1 | 6/2001 | Hickman | |
| 6,250,739 | B1 | 6/2001 | Serra | |
| 6,273,550 | B1 | 8/2001 | Brown | |
| 6,299,287 | B1 | 10/2001 | Williams et al. | |
| 6,460,969 | B1 * | 10/2002 | Pinkernell | 347/43 |
| 6,491,374 | B1 | 12/2002 | Bauer et al. | |
| 6,530,647 | B2 * | 3/2003 | Kubota et al. | 347/43 |
| 6,669,331 | B2 * | 12/2003 | Teshigawara et al. | 347/43 |
| 6,682,171 | B2 * | 1/2004 | Otsuka | 347/43 |
| 6,698,856 | B2 * | 3/2004 | Danzuka | 347/9 |

FOREIGN PATENT DOCUMENTS

EP 1 088 669 A2 4/2001

OTHER PUBLICATIONS

U.S. Appl. No. 60/534,879, entitled Ink Delivery System Apparatus and Method, filed Jan. 8, 2004 in the names of David A. Neese, et al.

* cited by examiner

*Primary Examiner*—K. Feggins
(74) *Attorney, Agent, or Firm*—Mark G. Bocchetti

(57) ABSTRACT

A color inkjet printer and method of printing includes a printer carriage supported for bi-directional movement along a print swath axis. Color inkjet printheads of different colors are mounted for movement with the carriage. The printheads are mounted in only two rows which are directed along the print swath axis. One row of the two rows of printheads is formed of printheads for printing a first primary color and a printhead for printing black. Another row of the two rows of printheads is formed of printheads for printing a second primary color and a printhead for printing yellow. Nozzle arrays of printheads for printing the first primary color and the nozzle array of the printhead for printing black do not overlap in the direction along the print swath axis with the nozzle arrays of printheads for printing the second primary color and the nozzle array of the printhead for printing yellow.

35 Claims, 9 Drawing Sheets

BI-DIRECTIONAL COLOR PRINTER AND METHOD OF PRINTING

CROSS-REFERENCE TO RELATED APPLICATION

This application is related to U.S. Application Ser. No. 60/534,879 entitled INK DELIVERY SYSTEM APPARATUS AND METHOD, filed on Jan. 8, 2004 in the names of David A. Neese, et al., the entire contents of which are incorporated herein by reference.

FIELD OF THE INVENTION

The invention relates to inkjet printing, and more particularly to an inkjet printer apparatus and method particularly suited for suppressed bi-directional banding or hue shift effects.

BACKGROUND OF THE INVENTION

Inkjet printers form a printed image by printing a pattern of individual dots at particular locations of an array defined for the printing medium. The locations are conveniently visualized as being small dots in a rectilinear array. The locations are sometimes referred to as "dot locations", "dot positions", or "pixels." Inkjet printers print dots by ejecting very small drops of ink onto the print medium to fill a pattern of dot locations with dots of ink. The printers typically include a movable carriage that supports the printheads for movement over the surface of the print medium. Each of the printheads has an array of ink ejection nozzles that are controlled to eject droplets of ink at appropriate times pursuant to commands of a microcomputer or other controller. The timing of the application of the ink droplets is intended to correspond to the pattern of the pixels of the image being printed.

Color inkjet printers commonly employ a plurality of printheads, mounted in the print carriage to produce different colors. Each printhead contains ink of a different color, with the commonly used colors being cyan, magenta, yellow and black. The various colors are produced by depositing droplets of the required colors onto dot locations. Secondary or shaded colors are formed by depositing drops of primary different colors on adjacent or overlapping dot locations with the human eye interpreting the color mixing as the secondary or shaded colors.

Print quality is one of the most important considerations of competition in the color inkjet printer field. As the image output of a color ink-jet printer is formed of millions of individual ink droplets, the quality of the image is ultimately dependent upon the quality of each ink droplet and the arrangements of the ink droplets on the print medium.

With reference to FIG. 1, a printhead arrangement 5 employed in the past has typically used printheads comprising linear arrays of print elements such as nozzles, wherein printheads of different colors are arranged one next to the other in a single row in the direction of the swath axis or scan axis, arrows A–B. This may be referred to as the so-called in-line case illustrated by printheads 5Y, 5M, 5C and 5K. There are several negative consequences of such an arrangement where bi-directional printing is employed. One is that, when the printer carriage is going from left-to-right, the colors are laid down in one order, say YMC for example. When the carriage goes in the other direction, from right-to-left, the colors are laid down in the opposite order, CMY in this example. The problem with this is that the blue made by first printing cyan and then magenta is slightly different from the blue made in the reverse order. This is because the final dot will inevitably cover a bit of the first dot. The slight color difference between the left-to-right printing and the right-to-left printing is called color hue shift. The color hue shift causes bi-directional hue shift banding, an outstanding image defect for inkjet printing. Of course, the blue color shifting is only one example as other colors will also suffer from hue shift banding in a similar fashion.

In order to overcome this problem, a fully staggered printhead layout may be employed wherein each of the printheads are staggered in the direction of the print medium advancement so that no two printheads are in the same row when moved in the direction of the print swath axis. An example of the fully staggered printhead arrangement 7 is shown in FIG. 2. In this arrangement, printheads 7Y, 7M, 7C and 7K are positioned so that they are spaced in the media advance direction, arrow C, and when operated for printing, no two printheads print dots on top of each other when moved together in one of the carriage advancements in the direction of the print swath axis, arrows A–B, within a swath. The resulting color sequence of printing one color upon another is independent of carriage movement direction. Therefore, there is no bi-directional hue shift banding. However, the fully staggered layout causes the length of the print zone to be significantly increased. For example, in FIG. 1, the print zone length L, of the in-line printheads layout is the same as the printhead height H. In FIG. 2 for the fully staggered printhead layout, the print zone length L, is at least four times that of the printhead height H. A large print zone length is not preferred because of the difficulty of maintaining a constant spacing distance between the printheads and the medium being printed upon. Also, a small angular error in the media feed axis results in greater relative dot placement errors between printheads. Where the printer includes additional printheads having different shades of at least some of the primary colors providing a fully staggered layout undesirably causes substantial increase to the print zone of the printer.

SUMMARY OF THE INVENTION

In accordance with the invention there is provided a method and apparatus for bi-directional color inkjet printing comprising providing a printer carriage for bi-directional movement along a print swath axis and providing a plurality of color inkjet printheads of different colors, each printhead having a nozzle array for emitting droplets of ink. The printer carriage supports all of the plurality of color inkjet printheads so as to form only two rows of printheads. Two or more respective printheads are supported for printing a first primary color and there is additionally supported a respective printhead for printing black. These printheads are positioned in a row directed along the print swath axis and form one row of printheads. Two or more printheads are supported for printing a second primary color and there is additionally supported a respective printhead for printing yellow and these printheads are positioned in a row directed along the print swath axis and form a second row of printheads. Nozzle arrays associated with the printheads for printing the first primary color and a nozzle array of the printhead for printing black do not overlap in the direction of the swath axis direction with nozzle arrays associated with the printheads for printing the second primary color and a nozzle array of the printhead for printing yellow. The printer carriage is moved in a first direction along the swath axis from one side of a print area to a second opposite side of the print area while driving one or more of the printheads to emit droplets onto a print medium. Relative motion is also provided between the print medium and the carriage in a direction transverse to the swath axis. The printer carriage is moved in a second direction along the swath axis from the second side of the print area to the first side, while driving one or more of the printheads to emit droplets onto the print medium to establish bi-directional printing. When the printer carriage moves in each of the first and the second directions along the swath axis, droplets of ink of the first primary color and of the second primary color are deposited at least partially overlapping on the medium to form dots of a color different than the first and second primary colors, and further, the first primary color and the second primary color are different primary colors and different in color from yellow and black.

The printheads for printing the first primary color preferably include different inks for respectively printing a relatively lighter and relatively darker version of the first primary color and the printheads for printing the second primary color include different inks for respectively printing a relatively lighter and relatively darker version of the second primary color.

BRIEF DESCRIPTION OF THE DRAWINGS

The advantages and features of the disclosed invention will readily be appreciated to a person skilled in the art from the following detailed description when read in conjunction with the drawings wherein.

DETAILED DESCRIPTION OF THE INVENTION

The present description will be directed to the elements forming part of, or cooperating more directly with, apparatus and methods in accordance with the present invention. It is to be understood that elements not specifically shown or described may take various forms well known to those skilled in the art.

Figure 3:
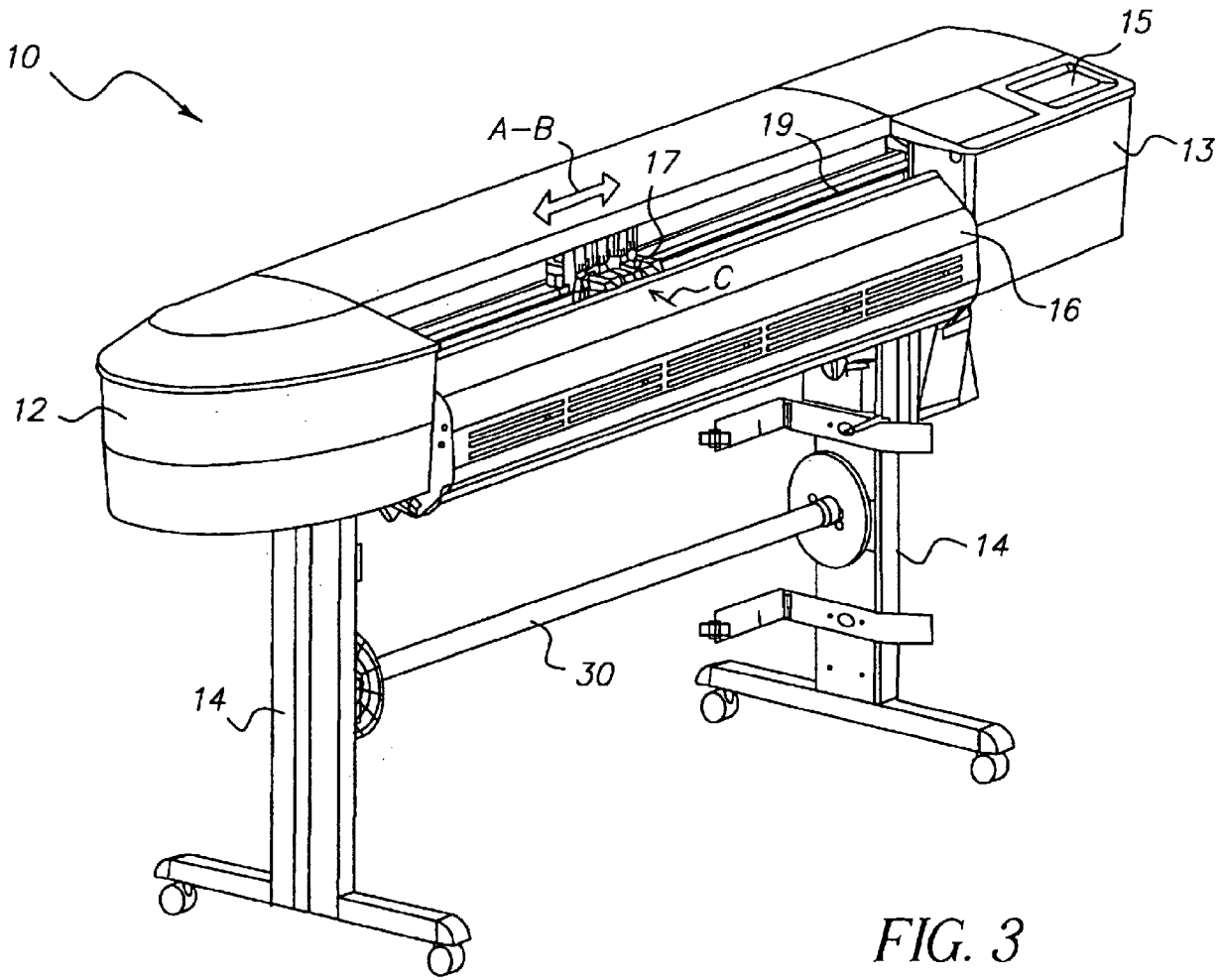
FIG. 3 is a prospective view of a wide format inkjet printer in which the invention may be incorporated.

Referring to FIG. 3, the wide format inkjet printer 10 includes a left side housing 12, a right side housing 13, and is supported by a pair of legs 14. A wide format or large format inkjet printer is typically floor standing. It is capable of printing on media larger than A2, or wider than 17 inches. In contrast, a desktop, or small format printer typically prints on media size 8.5 in. by 11 in. or 11 in. by 17 in., or the metric standard A2 or A3. The invention described herein, although illustrated with reference to a large format printer is also suited for use with a desktop printer. The media upon which the ink dots are deposited, will be referred to herein as paper, however, other media materials such as plastics and fabrics may also be used. In addition, the ink in the printheads may be edible for decorating food materials such as cakes, cookies and other edible articles.

The right side housing 13 shown in FIG. 3 has a display with keypad 15 on top for operator input and control and encloses various electrical and mechanical components, including the main electronic board (not shown) and the service station (not shown), which are related to the operation of the printer, but not directly pertinent to the present invention. A media drying blower 16, which works with a media heater (not shown) to drive moisture out of the media surface, is also not the focus of the present invention. The left side housing 12 encloses an ink supply station, which contains large volumes of ink supplies as part of ink delivery system for the inkjet printer and further explanation thereof may be found in the application cross-referenced to and incorporated herein by reference.

Figure 4:
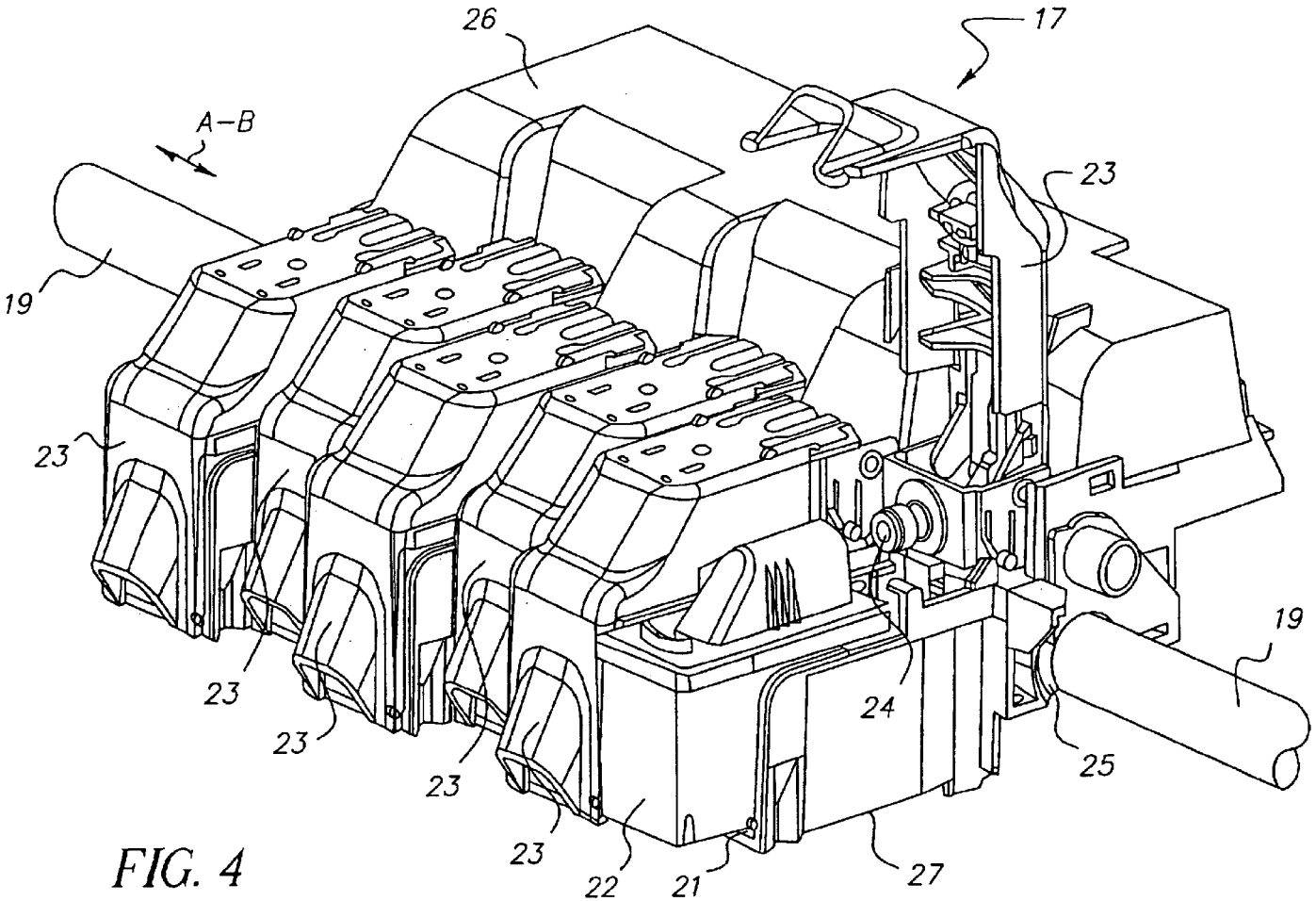
FIG. 4 is a prospective view of the printer carriage assembly in the inkjet printer shown in FIG. 3.

As shown in FIG. 3, a carriage assembly 17 rides on a guiding shaft 19 and bi-directionally moves along the scanning direction A-B, which will be referred to herein as the print swath axis or print scan axis. FIG. 4 shows the detailed structure of the carriage assembly 17, which comprises a plurality of stalls 21, each adapted to hold a disposable inkjet printer cartridge 22. The carriage assembly 17 shown in FIG. 4 has six stalls to house six disposable print cartridges, respectively, holding inks of different color types, i.e., cyan, magenta, yellow, black, light cyan and light magenta. A print cartridge 22 is inserted into a cartridge stall, a cartridge door 23, which is pivotally connected to the rear of the stall, is pushed down to the closed position to ensure secure fluid connection between the cartridge and a septum port 24 and secure electrical connection between the cartridge and a flex circuits (not shown) in the cartridge, which is further connected to a carriage electronic board and closed under the carriage cover 26. Each print cartridge 22 includes a printhead 27 attached on the bottom surface. The printhead 27, associated with each print cartridge 22, has a nozzle plate with an array of nozzles. The array of nozzles may comprise one or more columns to eject ink droplets for image printing. The printheads employed may operate in accordance with thermal or piezoelectric actuation as drop-on-demand or continuous inkjet printheads.

Typically in printers of this type, the number of nozzles provided is insufficient to print the entire image during a print pass and thus plural print passes are required to print an image with the receiver media being indexed in the direction of the arrow C after each pass. Thus, it may be said that the images are printed a swath at a time. However, a modification to this last statement exists for the situation wherein a printing technique known as "print masking" is used which will be explained below. Where print masking is used, typically no fraction of the printhead height indexing of the receiver media is done and the image is printed through multiple passes of the printhead. In the following description it will be understood that a print pass may be accomplished also during a return movement of the nozzles to their starting positions so that bi-directional print passing may be said to occur.

The carriage assembly 17 engages the shaft 19 through the sliding bushings 25, which are rigidly mounted on the printer structure, to ensure that the carriage assembly movement is linear and smooth. In operation, each ink-jet printhead 27 faces the receiver media and is mounted on the print cartridge, which in turn is mounted on the carriage assembly 17. The carriage assembly 17 is coupled through a timing belt (not shown) with a driver motor (not shown), and is reproducibly movable along the width of the receiver media (in the directions of the arrows A–B, i.e. the print swath or print scan axis). Each inkjet printhead 27 receives ink from the respective print cartridge. A transport roller (not shown), when driven by drive motor (not shown), transports the receiver media in the receiver media advance direction (arrow C) perpendicular to the moving direction of the carriage 17. Roll media (not shown) can be mounted on the media roll holder 30 for a continuous supply of receiver media, or discrete sheets of receiver media (not shown) can be fed in printer 10.

Upon receiving the image data, the printer electronics translates the data into printer actions, including sending electrical impulse signals to the printheads on the print cartridges 22 to eject ink droplets on the receiver media to form images, moving the carriage 17 back-and-forth in the direction of the swath axis or scan axis to cover the receiver media width, and stepping advance of the receiver media in a direction C, orthogonal to the carriage scanning direction or swath or scan axis direction A-B.

Figure 12:
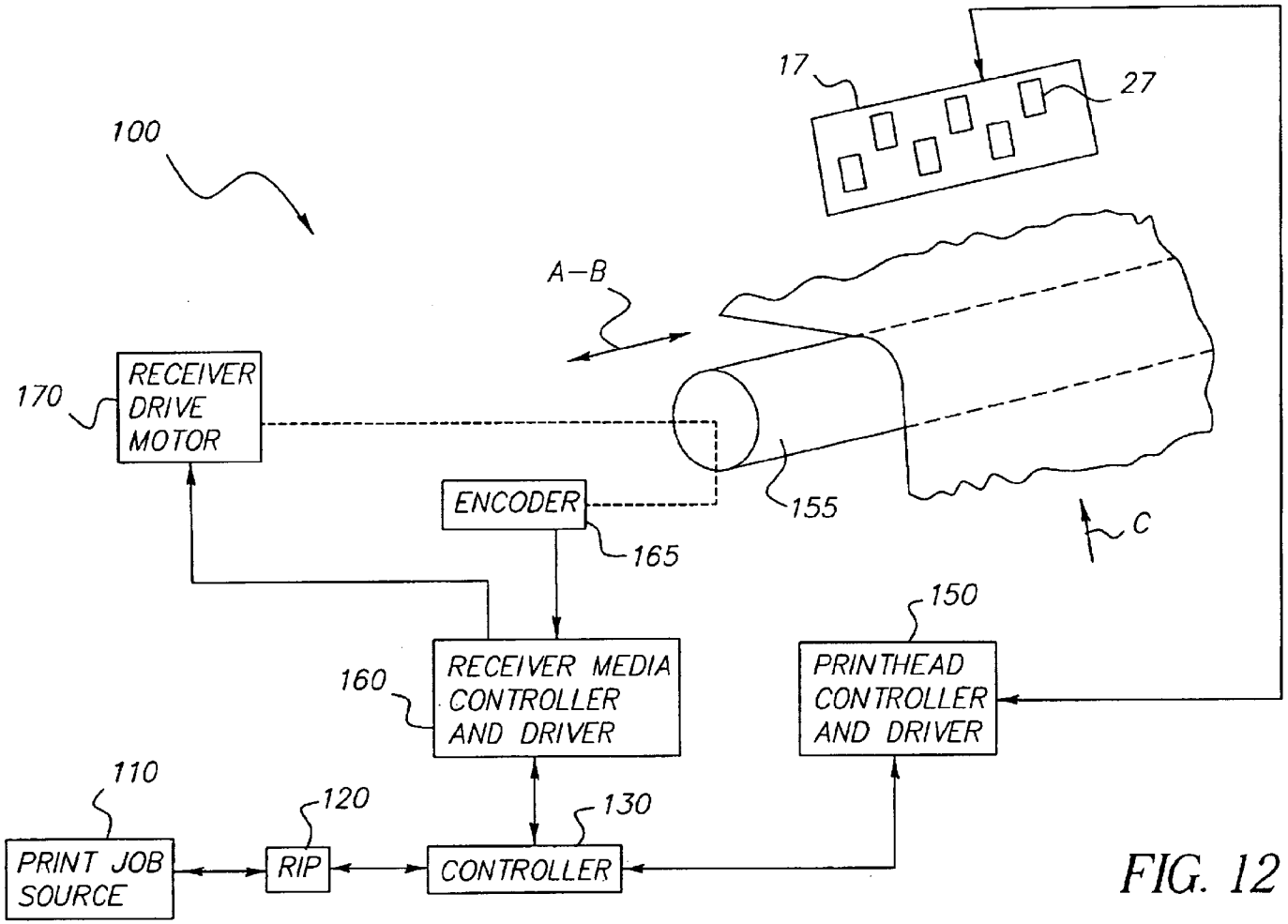
FIG. 12 is a block diagram of a control system for controlling the printer of FIG. 3.

Referring now to FIG. 12, an ink jet printer control system 100 is shown in which a controller 130 controls a printhead controller and driver 150 and a receiver media controller and driver 160. The controller 130, which may include one or more microcomputers suitably programmed, provides signals to the printhead controller and driver 150 that directs the printhead driver to move the carriage 17 and thus the printheads 27 in the fast scan direction or swath or scan axis direction; i.e. direction A-B. While the printheads are moving in the fast scan direction during a print pass, the printhead controller 150 directs the printheads to eject ink droplets onto the receiver media at appropriate pixel locations on a raster when pixels are being printed in accordance with the image data. After a print pass, the receiver media controller and driver 160 directs the receiver media drive motor 170 to rotate the platen 155 supporting the receiver or rotate other drive rollers involved in advancing the receiver media to move the receiver media in the media advance direction or slow scan direction, arrow C. Signals output from the printhead controller are responsive to data signals input thereto from a suitable electronic data source 110 that provides a data file of an image to be printed. The data source may comprise a computer terminal, network, scanner or other source of digital image data. A raster image processor 120 controls image manipulation. The electronic data source and raster image processor may be remote from the printer and the resultant image file may be delivered to the printer via a remotely located computer through a communications port. On board memory stores the image file or a portion thereof while the printer is in operation. The image signal may represent a two dimensional array composed of individual picture elements, or pixels, having a number of rows and number of columns. For color printers, a two dimensional array is created for each color channel, which in turn corresponds to an ink. For color printers, the image signal is the collective set of two-dimensional arrays. The raster image processor may perform standard image processing functions such as the sharpening, resizing, color conversion and multi-toning to produce a multi-tone image signal or an image signal where each pixel is represented by more than a single bit of image data in order to print each pixel with a variation in drop size. An encoder 165 may be provided for indicating movement of the receiver media in the media advanced direction. In addition, an encoder may be associated with the carriage 17 for indicating movement of the carriage in the swath scan direction.

Before a print pass, the print medium is lined up with the nozzle array such that the nozzles will eject drops during a print pass by printing dots of ink in the form of a raster on the receiver media. It will be understood that, while only a few nozzles are illustrated in the accompanying figures, hundreds and even thousands of nozzles may be on a printhead with a certain nominal nozzle spacing between nozzle centers of, for example, 1/300th of an inch or 1/600th of an inch between nozzle centers.

Figure 5:
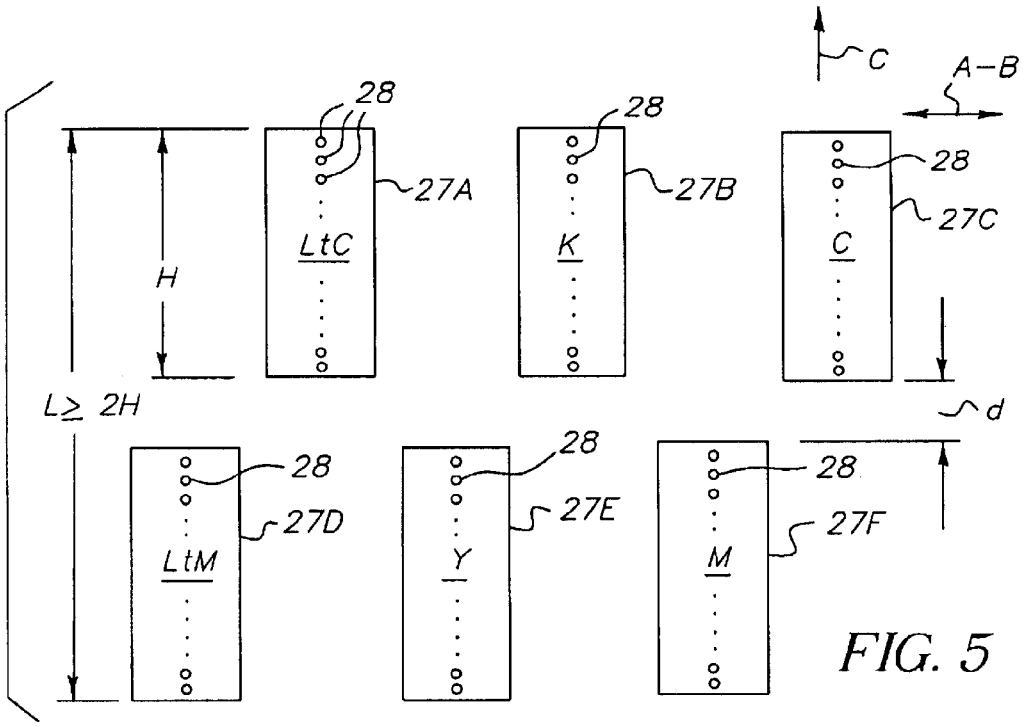
FIG. 5 is a schematic plan view of a six color printhead system and showing a preferred embodiment of the invention for use in the printer of FIG. 3.

A typical ink jet printer reproduces an image by ejecting small drops of ink from a printhead containing an array of spaced apart nozzles (28 in FIG. 5). The ink drops ejected from the printhead land on a receiver medium (typically paper) to form substantially round ink dots. In some printers, all drops are about the same size, and therefore, all dots are about the same size. Normally, these drops are deposited with their respective dot centers on a rectilinear grid or raster, with equal spacing in the horizontal and vertical directions.

Modern ink jet printers may also possess the ability to vary (over some range) the amount of ink that is deposited at a given location on the page. Inkjet printers with this capability are referred to as "multi-tone" or gray scale or "multidrop capable" inkjet printers because they can produce multiple density tones at each pixel location on the page. Some multi-tone inkjet printers achieve this by varying the volume of the ink drop produced by the nozzle by changing the electrical signals sent to the nozzle, or by adjusting the geometry of the drop ejection element including selecting a nozzle of different diameter. See for example U.S. Pat. No. 4,746,935. Other multi-tone inkjet printers produce a variable number of smaller, fixed size droplets that are ejected by the nozzle (or by plural nozzles during different passes of the nozzle array), all of which are intended to merge and land at the same pixel location on the page. See for example U.S. Pat. No. 5,416,612. These techniques allow the printhead to vary the size or optical density of a given ink dot, which produces a range of density levels at each dot location, thereby improving the image quality. Thus, printing methods that require multiple drop sizes usually depend upon the way the drops are generated by the printhead. As noted above, some printheads have multiple size nozzle diameters, others have circuitry in which the individual ink chambers accept changing electrical signals to instruct each chamber how much ink to eject. Still other printheads have nozzles that eject a variable number of small, fixed size droplets that are intended to merge then land in a given image pixel location. Printing methods that deposit more than one drop in the pixel location are typically carried out by multiple printing passes wherein the printhead prints a row of pixels multiple times, the image data to the printhead changing in accordance with each pass so that the correct number of total droplets deposited at any pixel location is commensurate with the density required by the processed image data.

With reference now to FIG. 5, there is illustrated a first arrangement of the different color printheads in accordance with the invention and suited for use on the printer of FIG. 3. It will be noted that the six printheads, 27A–F are arranged in two rows of three printheads each. In the first row, the printheads 27A–C are arranged so that the black ink containing and printing printhead 27B is located between the two cyan ink containing and printing printheads 27A and 27C. The two cyan printing printheads have inks of different shades so that one of these printheads prints a darker cyan than the other. Typically, one of the printheads 27A or 27C prints using a light cyan color ink and the other prints using a normal or darker cyan color ink. In the second row of printheads 27D–F, a printhead 27E contains and prints with a yellow color ink and is located between two printheads 27D and 27F which contain and print with magenta colored inks. One of the two printheads 27D or 27F prints with a light magenta color ink and the other prints using a normal or darker magenta color ink. It will be noted that this arrangement reduces the number of rows of printheads to only two rows and is quite suited for bi-directional printing. The spacing d, between the rows is preferred to be a minimum to reduce the print zone length L. Since black is a neutral color and its printhead 27B is positioned between the light cyan and cyan printheads 27A, 27C, the hue shift of the combination of cyan, black, light cyan combination is minimal in bi-directional printing. Likewise, yellow is the least sensitive color for color change among all colors, and hue shift for the magenta, yellow, light magenta combination is also minimized. Therefore, hue shift banding is substantially minimized by this arrangement of the six printheads and there is provided a minimal print zone length L. Print zone length L may be as small as twice the length of the printheads or 2H. Nozzle arrays associated with the printheads for printing the first primary color and a nozzle array of the printhead for printing black do not overlap in the direction of the swath axis direction with nozzle arrays associated with the printheads for printing the second primary color and a nozzle array of the printhead for printing yellow. This implies that during printing in a pass, drops of ink from the nozzles of the printheads of one row do not overlap with drops of ink from the nozzles of the printheads in the second row.

Figure 6:
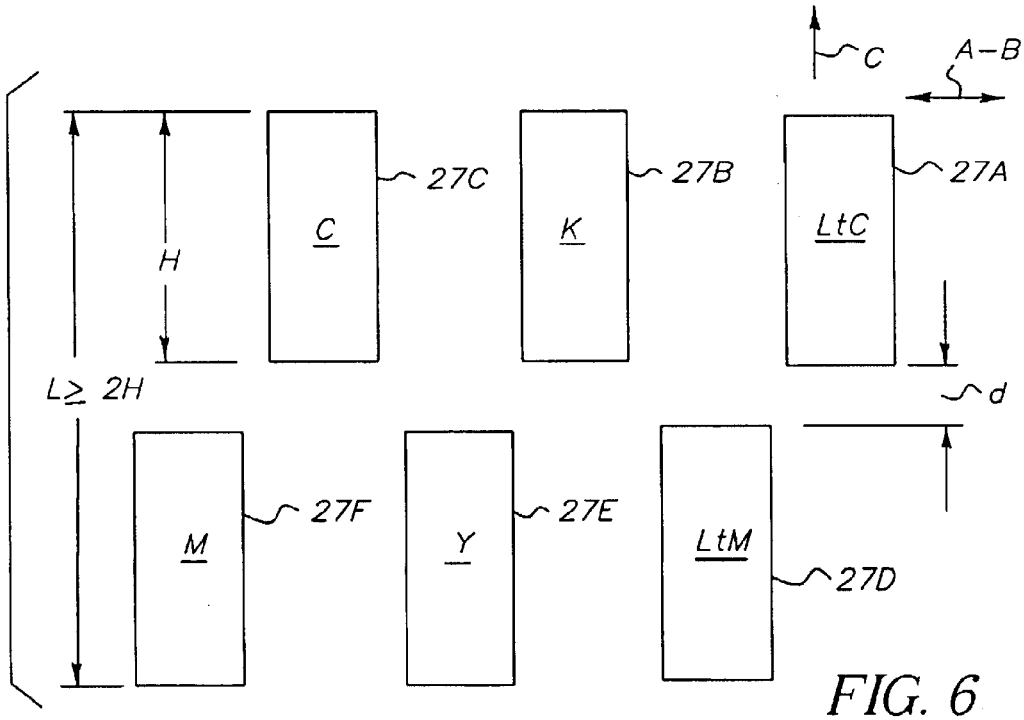
FIG. 6 is a schematic plan view of a six color printhead system and showing a second embodiment of the invention for use in the printer of FIG. 3.

With reference now to FIG. 6, there is illustrated a second arrangement of the six different color printheads in accordance with the invention. Note that in FIG. 6 the nozzles 28 are not shown on the printheads 27A–F but are present. It will be further noted that although the nozzle array is shown in FIG. 5 as a single linear column of nozzles that each printhead may include more than one column of nozzles, see in this regard the embodiment of FIG. 11.

In the embodiment of FIG. 6 the six printheads 27A–F are also arranged in two rows the only difference being in this embodiment that there has been rearrangement in the first row of the light cyan printhead 27A and cyan printhead 27C, and rearrangement in the second row of the light magenta printhead 27D and magenta printhead 27F. In both embodiments of FIGS. 5 and 6 the black printhead is between the two cyan printheads and the yellow printhead is between the two magenta printheads.

Figure 7:
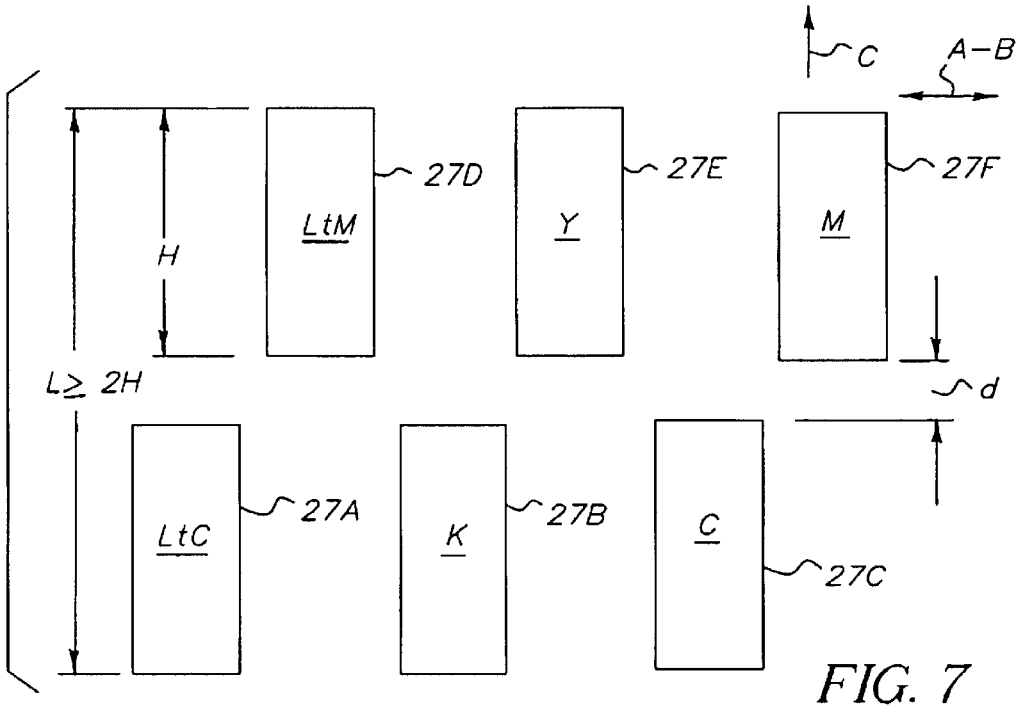
FIG. 7 is a schematic plan view of a six color printhead system and showing a third embodiment of the invention for use in the printer of FIG. 3.

In the third embodiment of the invention illustrated in FIG. 7 there is shown a printer arrangement with two rows of color printheads 27A–F wherein the arrangement of printheads is similar to that of FIG. 5 except that the first row of printheads shown in FIG. 5 is now positioned as the second row of printheads in FIG. 7 and the second row of printheads shown in FIG. 5 is now positioned as the first row of printheads in FIG. 7.

Figure 8:
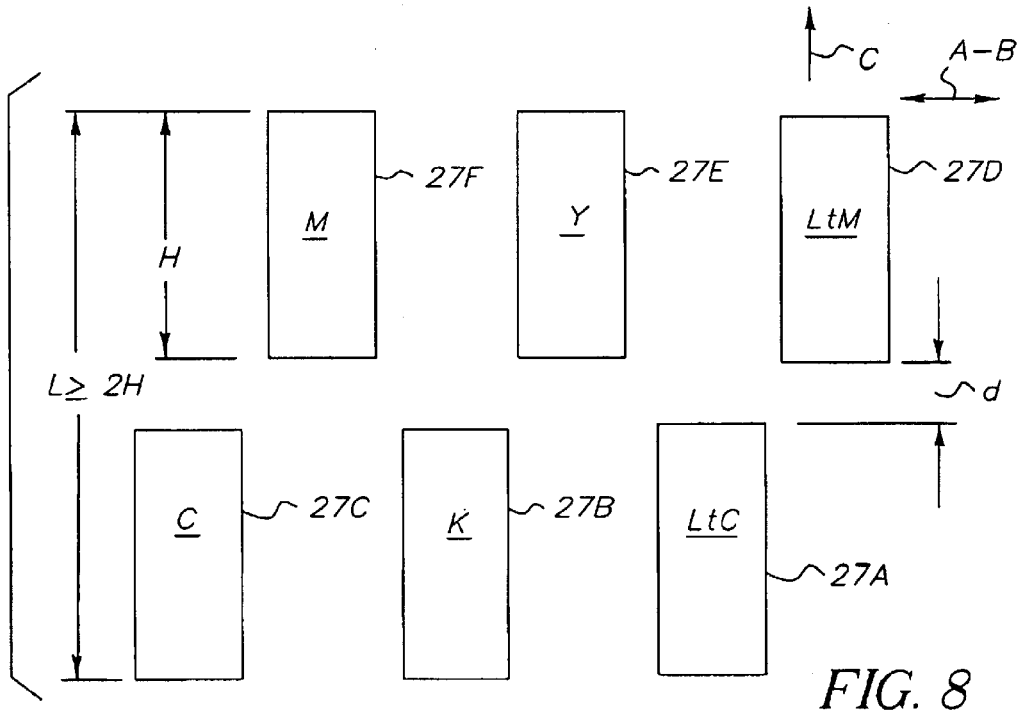
FIG. 8 is a schematic plan view of a six color printhead system and showing a fourth embodiment of the invention for use in the printer of FIG. 3.

With reference now to FIG. 8, which comprises a fourth embodiment of the invention, there is illustrated a printer arrangement with two rows of color printheads wherein the arrangement of printheads of FIG. 7 is shown rearranged so that in the first row there is a switching of positions of the light magenta printhead 27D and magenta printhead 27A, and similar rearrangement in the second row of the switching of positions of the light cyan printhead 27A and cyan printhead 27C. In both embodiments of FIG. 7 and FIG. 8 the black printhead 27B is between the two cyan printheads and the yellow printhead 27E is between the two magenta printheads.

Figure 9:
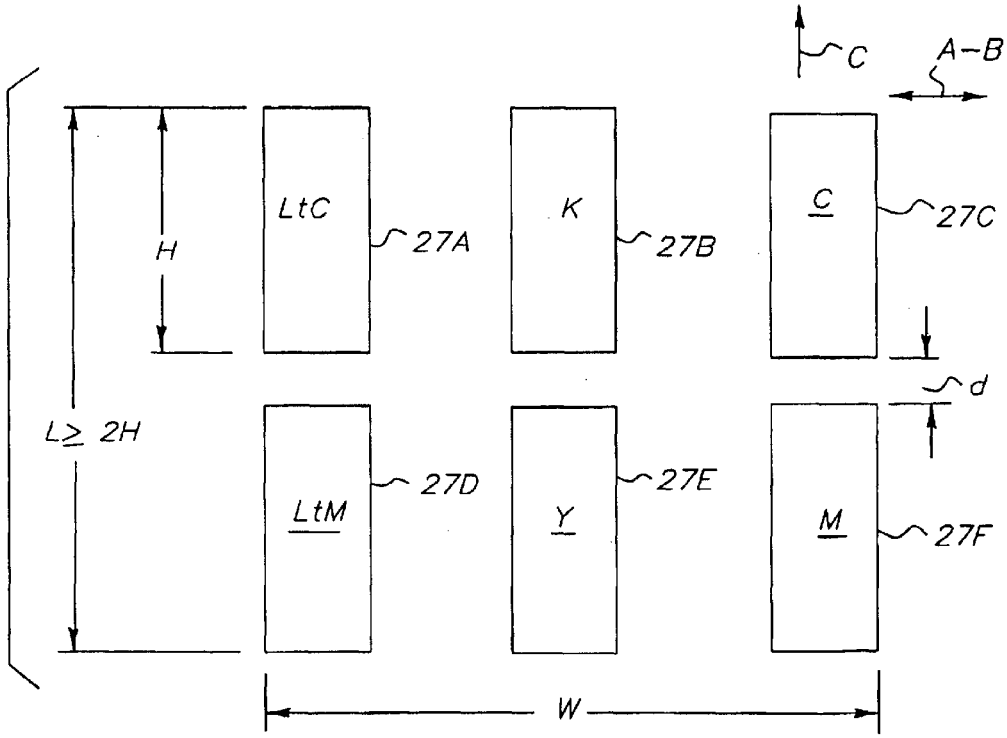
FIG. 9 is a schematic plan view of a six color printhead system and showing a fifth embodiment of the invention for use in the printer of FIG. 3.
Figure 2:
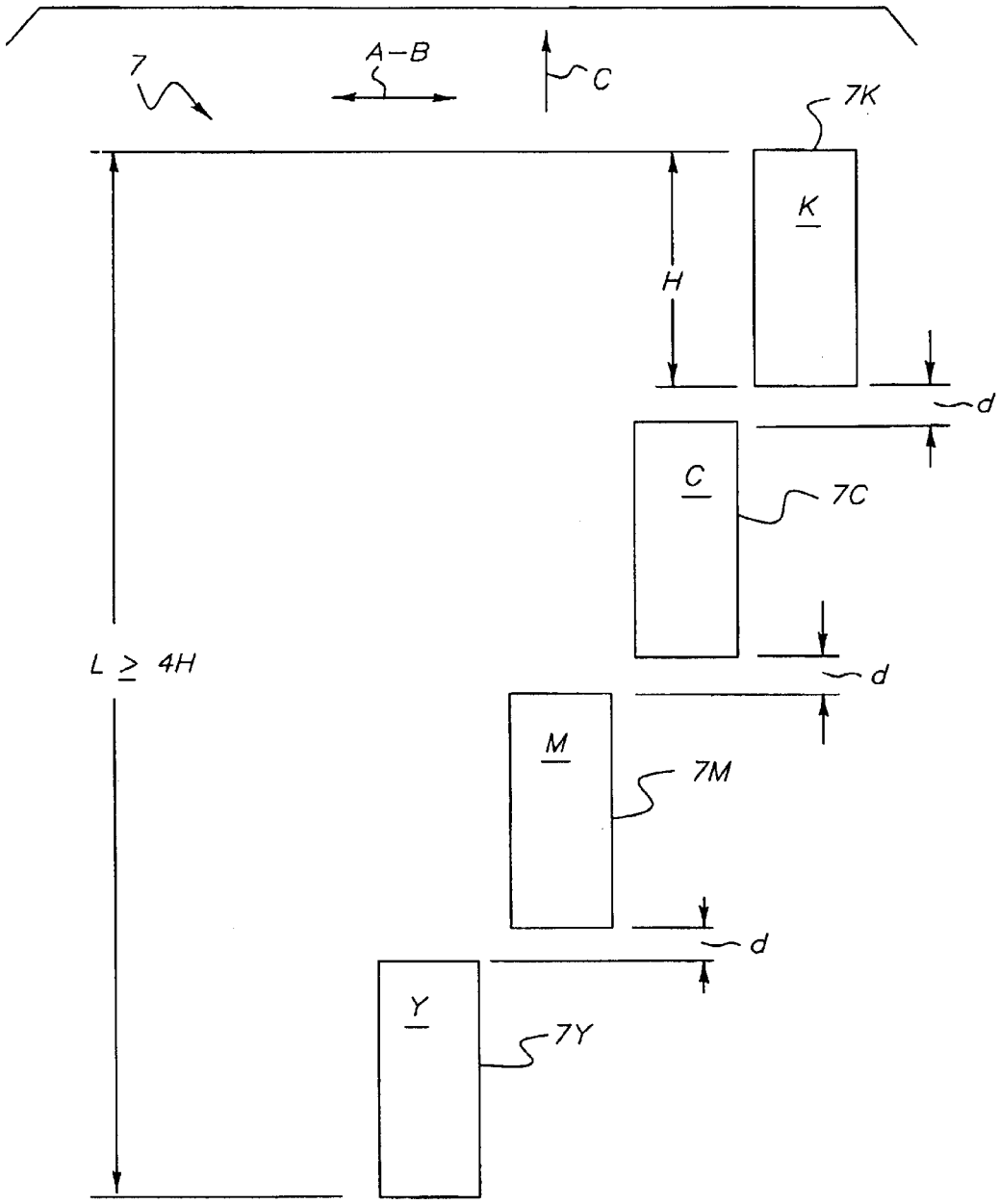
PRIOR ART FIG. 2
FIG. 2 is a schematic plan view of a second multiple printhead color inkjet printer of the prior art and illustrating the fully staggered arrangement of the different color printheads.

With reference now to FIG. 9, which illustrates a fifth embodiment of the invention, the order of the printheads 27A–F is similar to that of FIG. 5 except that there is no offset in the direction of the swath scan axis (A-B) between the printheads of the first row and the printheads of the second row.

It should also be understood that in the embodiments of FIGS. 5–9 that the black printhead may be substituted for the yellow printhead and the yellow printhead may be substituted for the black printhead, so that for example, in FIG. 5 the black printhead may be between the two magenta printheads and the yellow printhead may be between the two cyan printheads.

Figure 10:
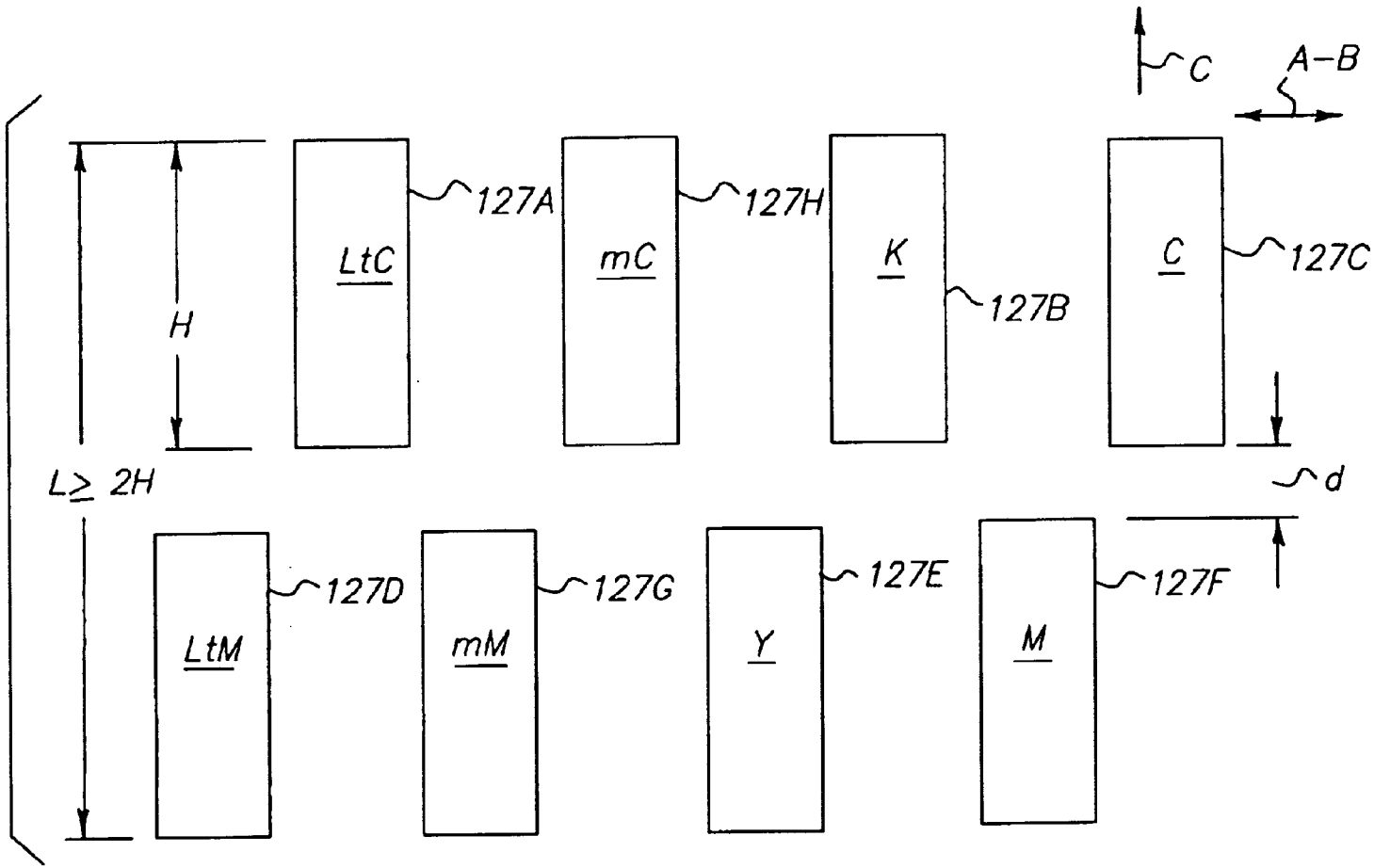
FIG. 10 is a schematic plan view of an eight color printhead system and showing a sixth embodiment of the invention for use in the printer of FIG. 3.

With reference now to FIG. 10, eight printheads 127A–H are illustrated being arranged in two rows with the addition of a third shade of color for each of the cyan and magenta colors. Thus, in the first row of printheads there are shown respective printheads for light cyan 127A, medium cyan 127H, black 127B and regular cyan 127C. In the second row of printheads there are shown printheads for light magenta 127D, medium magenta 127G, yellow 127E and regular magenta 127F. It will be understood that in the embodiments using eight printheads that the black ink containing printhead may be between any of the cyan shaded ink containing printheads and that the yellow ink containing printhead may be between any of the magenta shaded ink containing printheads. Similarly to the examples provided above, the yellow ink containing printhead may be substituted for the black ink containing printhead and the black ink containing printhead substituted for the yellow ink containing printhead so that each of the yellow and black ink containing printheads are in one of the two rows of printheads and are between at least a pair of cyan shaded ink containing printheads or a pair of magenta shaded ink containing printheads.

Figure 13:
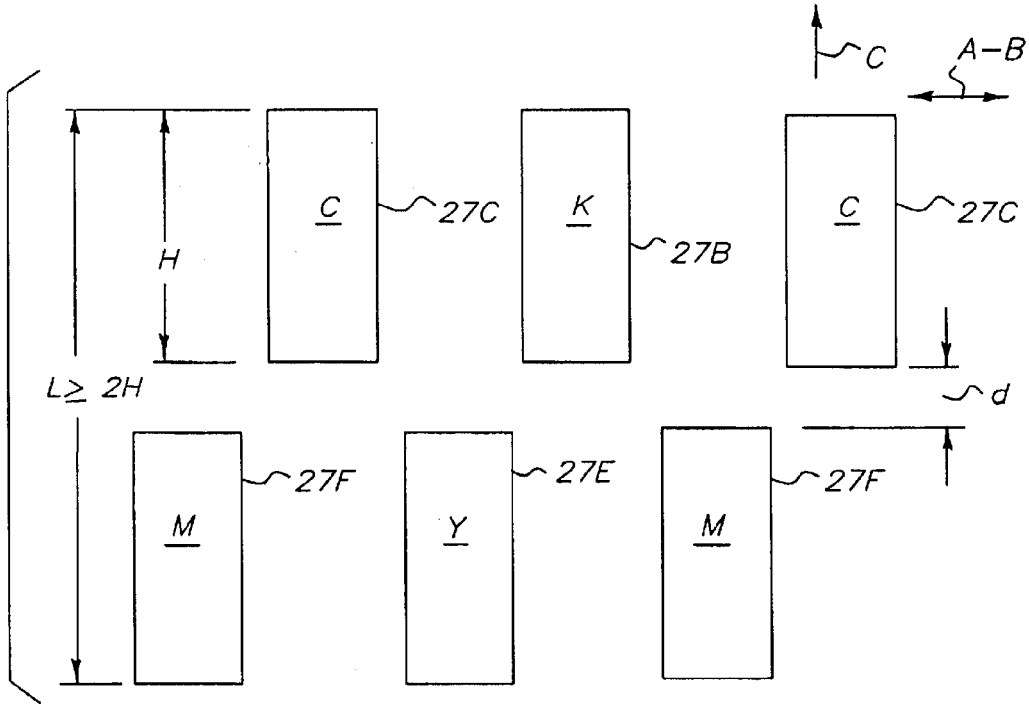
FIG. 13 is a schematic plan view of a six color printhead system showing a seventh embodiment of the invention for use in the printer of FIG. 3.

In FIG. 13, still another embodiment of the invention is illustrated wherein two rows of printheads are provided, the first row including two cyan printing printheads 27C having cyan ink of the same or identical shade. The two cyan printing printheads 27C are separated in the scan axis direction, A-B, by a black printing printhead 27B that includes black ink. The second of the two rows of printheads includes two magenta printing printheads 27F having magenta ink of the same shade. The two magenta printing printheads 27F are separated in the scan or swath axis direction by a yellow printing printhead 27E. In addition to the described advantages set forth herein of consistent color rendition due to substantial reduction of color hue shift during bi-directional printing, the embodiment of FIG. 13 provides for increased supply of ink stored on the carriage. In this regard, a second black ink containing printhead may be provided between the two cyan ink containing printheads or between the two magenta ink containing printheads. Similarly and additionally, a second yellow ink containing printhead may be provided between the two cyan ink containing printheads or between the two magenta ink containing printheads. Still further modifications include substitution of the yellow printing printhead 27E for the black printing printhead 27B and the black printing printhead for the yellow printing printhead so that the yellow printing printhead is between the two cyan printing printheads and the black printing printhead is between the two magenta printing printheads. Additionally, the order of the two rows of printheads is not critical and thus, the row of printheads including the magenta and yellow printing printheads may be the first of the two rows and the row of printheads including the cyan and black printing printheads may be the second of the two rows of printheads.

Figure 1:
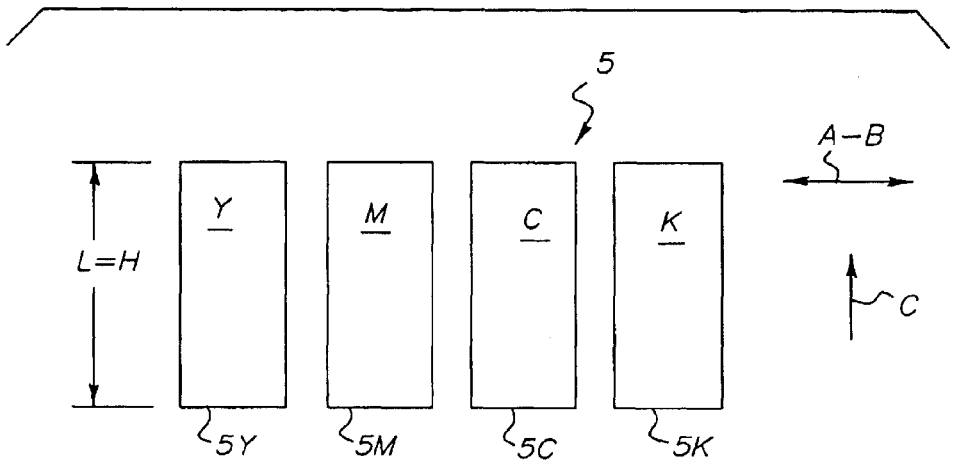
PRIOR ART FIG. 1
FIG. 1 is a schematic plan view of a first multiple printhead color inkjet printer of the prior art and illustrating the in-line arrangement of the different color printheads.
Figure 11:
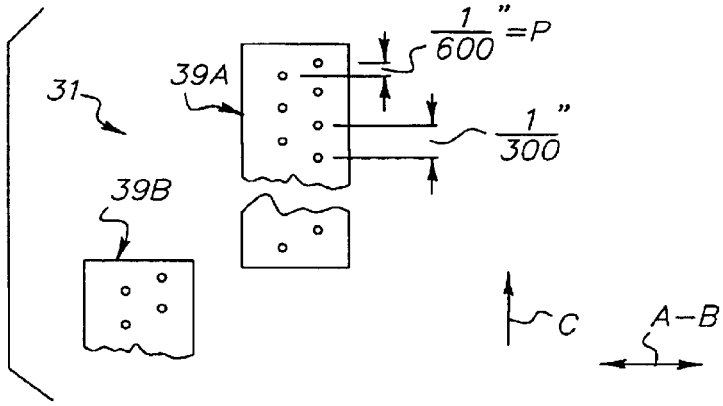
FIG. 11 is a schematic plan view of a single printhead made up of two printhead segments or modules.

With reference to FIG. 11 the printhead 31 for each color of ink to be printed includes in this embodiment two printhead segments or modules 39A and 39B. Each printhead segment includes two staggered columns of nozzles and each column of nozzles has, for example, a spacing of 1/300 of an inch between adjacent nozzles in the column. However, due to the presence of staggering, there is a nominal nozzle spacing on each printhead segment of 1/600 of an inch as indicated in the figure. The nozzles on the second segment are similar to that on the first segment and the segments are arranged to continue the nominal nozzle spacing for the printhead of 1/600 of an inch spacing or pitch p between nozzles. Printheads such as that described in FIG. 1I are more fully described in Newkirk et al., U.S. Pat. No. 6,244,688. It will be understood a printer 10 may be provided in accordance with the invention with six or more printheads each similar to that described for printhead 31. The six or more different color printheads are arranged on the carriage 17 in two rows as described for the embodiments of FIGS. 5–10. As the carriage is traversed across the receiver media for a print pass, the nozzles in each of the six or more color printheads are actuated to print with ink in their respective colors in accordance with image instructions received from the RIP.

The ink jet printer configurations employed herein comprise a plurality of inkjet printheads each of which has an array of nozzles. Each nozzle can eject drops independently, and each nozzle can eject at least two different volumes of ink including a drop of zero volume where essentially background is printed. Where at least three different volumes of ink (including a drop of zero volume) are capable of selectively being emitted from each nozzle such printers may be referred to as multi-tone printers. The printheads may be a drop on demand or continuous ink jet printing device. An inkjet printhead drive mechanism moves the printheads in a direction generally perpendicular to the array of nozzles. This direction is referred to as the fast scan or pass or swath scan direction. Mechanisms for moving the printhead in this direction are well known and usually comprise providing the support of the printheads or carriage on rails, which may include a rail that has a screw thread and advancing the printhead along the rails, such as by rotating the rail with the screw thread or otherwise advancing the printhead along the rails such as by using a timing belt and carriage. Such mechanisms typically provide a back and forth movement to the printhead. Information to the printhead, including data and control signals, can be delivered through a flexible band of wires or electro-optical link. As the printheads are transported in the fast scan direction, the nozzles selectively eject drops at intervals in accordance with enabling signals from a controller that is responsive to image data input into the printer. The intervals in combination with the nozzle spacing represent an addressable rectilinear grid, a raster, on which drops are placed. In response to an image pixel value, the printer may deposit a drop on a receiver medium, the drop being deposited on a location associated with a raster. It will be understood that rasters are not printed on the receiver sheet but represent a grid pattern of potential pixel locations.

A pass of the printheads during which drops are ejected is known as a print pass. The drops ejected during a print pass land on an inkjet recording medium. After one or more print passes, a print media drive moves the ink-jet recording medium or media; i.e. a receiver sheet such as paper, coated paper or plastic or a plate from which prints can be made, past the printheads in a slow scan direction orthogonal or transverse to the fast scan direction. After the recording medium or receiver member has been advanced, the printheads execute another set of one or more print passes. Printing during a next pass may be while the printheads are moving in the reverse direction to that moved during the prior pass. The receiver member may bea discrete sheet driven by a roller or other known driving device or the receiver sheet may be a continuous sheet driven, typically intermittently, by a drive to a take-up roller or to a feed roller drive.

Printheads are also known wherein each printhead includes two parallel columns of nozzles that are not staggered thus allowing printing of at least certain pixels using drops output by two nozzles in succession. In the field of inkjet printing it is also well known that if ink drops placed at neighboring locations on the page are printed at the same time, then ink drops tend to flow together on the surface of the page before they soak into the page. This can give the reproduced image an undesirable grainy or noisy appearance often referred to as "coalescence". It is known that the amount of coalescence present in the printed image is related to the amount of time that elapses between printing adjacent dots. As the time delay between printing adjacent dots increases, the amount of coalescence decreases, thereby improving the image quality. There are many techniques present in the prior art that describe methods of increasing the time delay between printing adjacent dots using methods referred to as "interlacing", "print masking", or "multi-pass printing". There are also techniques present in the prior art for reducing one-dimensional periodic artifacts or "bands". This is achieved by advancing the paper by an increment less than the printhead height so that successive passes or swaths of the printhead overlap. The technique of print masking and swath overlapping are typically combined. See, for example, U.S. Pat. Nos. 4,967,203 and 5,992,962. The term "print masking" generally means printing subsets of the image pixels per pass and printing the entire image pixels in multiple passes of the printhead relative to a recording medium.

The nozzle pitch dimension described may be, but need not be, the same as that of the raster grid pitch dimension; i.e. spacing between centers of adjacent pixels on the raster. The nominal nozzle pitch spacing could be greater than the spacing between the raster grid lines and accommodation made in the printing mode through control of signals to the printhead in the fast scan direction with printing at appropriate predetermined intervals to provide a desired pitch spacing for the grid in the fast scan direction and with control of movement of the media in the slow scan direction to provide the desired pitch spacing of the grid in the slow scan direction. It will also be understood that the raster grid need not have the pitch spacing in the fast scan direction that is the same as that in the slow scan direction.

In operation of the method and apparatus of the invention, bi-directional color inkjet printing is provided by employing a printer carriage that is operated with bi-directional movement along a print swath axis. A plurality of color inkjet printheads having inks of different colors are supported on the carriage for bi-directional movement therewith. Each printhead has a nozzle array for emitting droplets of ink. The color inkjet printheads are supported on the printer carriage so as to form only two rows of printheads. The printheads are arranged such that two or more respective printheads for printing a first primary color and a respective printhead for printing black are positioned in a row directed along the print swath axis and form one row of printheads and two or more printheads for printing a second primary color and a respective printhead for printing yellow are positioned in a row directed along the print swath axis and form a second row of printheads. Nozzle arrays associated with the printheads for printing the first primary color and a nozzle array of the printhead for printing black do not overlap in the direction of the swath axis direction with nozzle arrays associated with the printheads for printing the second primary color and a nozzle array of the printhead for printing yellow. During printing the printer carriage is moved a first direction along the swath axis from one side of a print area to a second opposite side of the print area while driving two or more of the printheads to emit droplets onto a print medium for producing color that is different in color from that of the inks being used to record. Relative motion between the print medium and the carriage in a direction transverse to the swath axis is also provided for and typically when printing is not being done. After a pass in a first direction, the printer carriage is then returned by movement in a second direction along the swath axis from the second side of the print area to the first side while driving two or more of the printheads to emit droplets onto the print medium for producing color that is different in color from that of the inks being used to record. The printheads for printing the first primary color preferably include different inks for respectively printing a relatively lighter and relatively darker version of the first primary color and the printheads for printing the second primary color include different inks for respectively printing a relatively lighter and relatively darker version of the second primary color. During multi-pass printing, droplets of ink from the first primary color and from the second primary color are deposited at least partially overlapping on the medium to form dots of a color different than the first and second primary colors.

The invention is not limited to the particular details of the disclosed apparatus and methods and other modifications and applications are contemplated. Certain other changes may be made in the above-described apparatus and method without departing from the true spirit and scope of the invention herein involved. It is intended, therefore, that the subject matter in the above depiction shall be interpreted as illustrative of certain preferred embodiments thereof, but it will be understood that variations and modifications can be effected within the spirit and scope of the invention.

Parts List

5 printhead arrangement
7 fully staggered printhead arrangement
10 inkjet printer
12 left side housing
13 right side housing
14 pair of legs
15 keyboard
16 media drying blower
17 carriage assembly
19 guiding shaft
21 plurality of stalls
22 disposable inkjet cartridge
23 cartridge door
24 septum port
25 sliding bushings
26 carriage cover
27 printhead (a–f)
28 nozzles
30 media roll holder
31 printhead
39*a* printhead segments
39*b* printhead segments
100 inkjet printer control system
110 electronic data source
120 raster image processor
127 printheads (a–h)
130 controller
150 printhead controller and drive
155 platen
160 receiver media controller driver
165 encoder
170 receiver media drive motor.

What is claimed is:

1. A method for bi-directional color inkjet printing comprising:

providing a printer carriage for bi-directional movement along a print swath axis;

providing a plurality of color inkjet printheads for printing with inks of different colors, each printhead having a nozzle array for emitting droplets of ink;

supporting all of the plurality of color inkjet printheads on the printer carriage so as to form only two rows of printheads such that two or more respective printheads for printing a first primary color and a respective printhead for printing black are positioned in a row directed along the print swath axis and form one row of printheads and two or more printheads for printing a second primary color and a respective printhead for printing yellow are positioned in a row directed along the print swath axis and form a second row of printheads, and wherein nozzle arrays associated with the printheads for printing the first primary color and a nozzle array of the printhead for printing black do not overlap in the direction of the swath axis direction with nozzle arrays associated with the printheads for printing the second primary color and a nozzle array of the printhead for printing yellow;

moving the printer carriage in a first direction along the swath axis from one side of a print area to a second opposite side of the print area while driving two or more of the printheads to emit droplets onto a print medium;

providing relative motion between the print medium and the carriage in a direction transverse to the swath axis;

moving the printer carriage in a second direction along the swath axis from the second side of the print area to the first side, while driving two or more of the printheads to emit droplets onto the print medium; and wherein the printer carriage moves in each of the first and the second directions along the swath axis, droplets of ink of the first primary color and of the second primary color are deposited at least partially overlapping on the medium to form dots of a color different than the first and second primary colors and further wherein the first primary color and the second primary color are of different primary colors and different in color from yellow and black.

2. The method of claim 1, wherein the printheads for printing the first primary color include different inks for respectively printing a relatively lighter and relatively darker version of the first primary color and the printhead for printing black is located between the printheads for printing the first primary color so that the black printing printhead is located between a first printhead that prints a relatively lighter version of the first primary color and a second printhead that prints a relatively darker version of the first primary color.

3. The method of claim 2, wherein the printheads for printing the first primary color additionally include a third printhead for printing a third shade of the first primary color that is different from the shade printed by the first printhead that prints a relatively lighter version of the first primary color and the second printhead that prints a relatively darker version of the first primary color.

4. The method of claim 2, wherein the first primary color is cyan and the second primary color is magenta.

5. The method of claim 2, wherein the first primary color is magenta and the second primary color is cyan.

6. The method of claim 2, wherein the printheads for printing the second primary color include different inks for respectively printing a relatively lighter and a relatively darker version of the second primary color and further wherein the printhead for printing yellow is located between the printheads for printing the second primary color so that the yellow printing printhead is located between a third printhead that prints a relatively lighter version of the second primary color and a fourth printhead that prints a relatively darker version of the second primary color.

7. The method of claim 6, wherein the printheads for printing the first primary color additionally include a fifth printhead for printing a third shade of the first primary color that is different from the shade printed by the first printhead that prints a relatively lighter version of the first primary color and the second printhead that prints a relatively darker version of the first primary color.

8. The method of claim 6, wherein the printheads for printing the second primary color additionally include a fifth printhead for printing a third shade of the second primary color that is different from the shade printed by the third printhead that prints a relatively lighter version of the second primary color and the fourth printhead that prints a relatively darker version of the second primary color.

9. The method of claim 6, wherein the first primary color is cyan and the second primary color is magenta.

10. The method of claim 6, wherein the first primary color is magenta and the second primary color is cyan.

11. The method of claim 7, wherein the printheads for printing the second primary color additionally include a sixth printhead for printing a third shade of the second primary color that is different from the shade printed by the third printhead that prints a relatively lighter version of the second primary color and the fourth printhead that prints a relatively darker version of the second primary color.

12. The method of claim 1, wherein the printheads for printing the second primary color include different inks for respectively printing a relatively lighter and a relatively darker version of the second primary color, and further wherein the printhead for printing yellow is located between the printheads for printing the second primary color so that the yellow printing printhead is located between a first printhead that prints a relatively lighter version of the second primary color and a second printhead that prints a relatively darker version of the second primary color.

13. The method of claim 12, wherein the printheads for printing the second primary color additionally include a third printhead for printing a third shade of the second primary color that is different from the shade printed by the first printhead that prints a relatively lighter version of the second primary color and the second printhead that prints a relatively darker version of the second primary color.

14. The method of claim 13, wherein the first primary color is cyan and the second primary color is magenta.

15. The method of claim 13, wherein the first primary color is magenta and the second primary color is cyan.

16. The method of claim 1, wherein the first primary color is cyan and the second primary color is magenta.

17. The method of claim 1, wherein the inks in the respective printheads for printing the first primary color are identical to each other in shade and the inks in the respective printheads for printing the second primary color are identical to each other in shade.

18. A color inkjet printer comprising:

a printer carriage supported for bi-directional movement along a print swath axis;

a plurality of color inkjet printheads for printing with inks of different colors, each printhead having a nozzle array for emitting droplets of ink of a respective color during movement of the printer carriage in each of the two opposed directions of the carriage movement, all the printheads being mounted upon the printer carriage in only two rows such that respective printheads for printing a first primary color and a respective printhead that includes black ink for printing black are positioned in one row along the print swath axis and form a first row of printheads and respective printheads for printing a second primary color and a respective printhead that includes yellow ink for printing yellow are positioned in a second row along the print swath axis and form a second row of printheads, and wherein the nozzle arrays of printheads for printing the first primary color and respective nozzle array of the printhead for printing black do not overlap in the direction along the print swath axis with the nozzle arrays of printheads for printing the second primary color and the nozzle array of the printhead for printing yellow and wherein the printheads for printing the first primary color include ink of the first primary color and the printheads for printing the second primary color include ink of the second primary color, and wherein the first primary color and second primary color are different in color from yellow and black.

19. The printer of claim 18, wherein the printheads for printing the first primary color include different inks for respectively printing a relatively lighter and relatively darker version of the first primary color and the printhead for printing black is located between the printheads for printing the first primary color so that the black printing printhead is located between a first printhead that prints a relatively lighter version of the first primary color and a second printhead that prints a relatively darker version of the first primary color.

20. The printer of claim 19, wherein the printheads for printing the first primary color additionally include a third printhead for printing a third shade of the first primary color that is different from the shade printed by the first printhead that prints a relatively lighter version of the first primary color and the second printhead that prints a relatively darker version of the first primary color.

21. The printer of claim 19, wherein the first primary color is cyan and the second primary color is magenta.

22. The printer of claim 19, wherein the first primary color is magenta and the second primary color is cyan.

23. The printer of claim 19, wherein the printheads for printing the second primary color include different inks for respectively printing a relatively lighter and relatively darker version of the second primary color and further wherein the printhead for printing yellow is located between the printheads for printing the second primary color so that the yellow printing printhead is located between a third printhead that prints a relatively lighter version of the second primary color and a fourth printhead that prints a relatively darker version of the second primary color.

24. The printer of claim 23, wherein the printheads for printing the second primary color additionally include a fifth printhead for printing a third shade of the second primary color that is different from the shade printed by the third printhead that prints a relatively lighter version of the second primary color and the fourth printhead that prints a relatively darker version of the second primary color.

25. The printer of claim 23, wherein the first primary color is cyan and the second primary color is magenta.

26. The printer of claim 23, wherein the printheads for printing the first primary color additionally include a fifth printhead for printing a third shade of the first primary color that is different from the shade printed by the first printhead that prints a relatively lighter version of the first primary color and the second printhead that prints a relatively darker version of the first primary color.

27. The printer of claim 26, wherein the first primary color is magenta and the second primary color is cyan.

28. The printer of claim 26, wherein the printheads for printing the second primary color additionally include a sixth printhead for printing a third shade of the second primary color that is different from the shade printed by the third printhead that prints a relatively lighter version of the second primary color and the fourth printhead that prints a relatively darker version of the second primary color.

29. The printer of claim 18, wherein the printheads for printing the second primary color include different inks for respectively printing a relatively lighter and relatively darker version of the second primary color and wherein the printhead for printing yellow is located between the printheads for printing the second primary color so that the yellow printing printhead is located between a first printhead that prints a relatively lighter version of the second primary color and a second printhead that prints a relatively darker version of the second primary color.

30. The printer of claim 29, wherein the printheads for printing the second primary color additionally include a third printhead for printing a third shade of the second primary color that is different from the shade printed by the first printhead that prints a relatively lighter version of the second primary color and the second printhead that prints a relatively darker version of the second primary color.

31. The printer of claim 30, wherein the first primary color is magenta and the second primary color is cyan.

32. The printer of claim 30, wherein the first primary color is cyan and the second primary color is magenta.

33. The printer of claim 18, wherein the first primary color is cyan and the second primary color is magenta.

34. The printer of claim 18, wherein a controller is coupled to the printheads to control the operation of the printheads so that droplets of ink of the first and second primary colors at least partially overlap during printing to form other colors on the receiver medium.

35. The printer of claim 18, wherein the inks in the respective printheads for printing the first primary color are identical to each other in shade and the inks in the respective printheads for printing the second primary color are identical to each other in shade.

* * * * *